United States Patent [19]

Satake

[11] 4,279,261

[45] Jul. 21, 1981

[54] AUTOMATIC SAFETY DEVICE FOR HULLING MACHINE

[75] Inventor: Toshihiko Satake, Higashihiroshima, Japan

[73] Assignee: Satake Engineering Co., Ltd., Tokyo, Japan

[21] Appl. No.: 84,425

[22] Filed: Oct. 12, 1979

[51] Int. Cl.[3] ..... B02B 3/04

[52] U.S. Cl. ..... 130/5 B; 130/30 G

[58] Field of Search ..... 130/5 R, 5 B, 5 C, 5 D, 130/30 G, 30 H, 30 R; 56/10.2; 99/618, 620

[56] References Cited

U.S. PATENT DOCUMENTS 4,066,012 1/1978 Satake et al. ..... 130/30 H

FOREIGN PATENT DOCUMENTS 597277 5/1960 Canada ..... 56/10.2

*Primary Examiner*—Robert A. Hafer

*Attorney, Agent, or Firm*—Norbert P. Holler; Charles A. Blank

[57] ABSTRACT

An automatic safety device for a hulling machine comprising a housing, a fixed hulling roll and a movable hulling roll forming a pair rotatably mounted parallel to each other in the housing, means for driving the two hulling rolls and means for forcing the movable hulling roll to move toward the fixed hulling roll. Each hulling roll has fitted thereover a metallic annular member and a resilient annular member in the indicated order. The automatic safety device includes detecting means for detecting that at least one of the resilient annular members of the hulling rolls has reached a predetermined wear limit radius, and a safety control electric circuit connected to said detecting means and including warning means and/or means for interrupting the operation of the means for driving the hulling rolls.

17 Claims, 9 Drawing Figures

AUTOMATIC SAFETY DEVICE FOR HULLING MACHINE

This invention relates to an automobile safety device for a hulling machine comprising a housing, a fixed rotary main shaft and a movable rotary ancillary shaft arranged in a pair and each mounting thereon a hulling roll having a resilient annular member formed as of rubber fitted over a metallic annular member, the pair of hulling rolls being arranged parallel to each other in the housing, means for driving the two shafts, and means for forcing the movable rotary ancillary shaft to move toward the fixed rotary main shaft, such automatic safety device being operative to automatically detect wear of the resilient annular members of the hulling rolls and issue warning or interrupt the operation of the means for driving the two shafts supporting the hulling rolls.

This type of hulling machine has hitherto had no device for indicating or reporting wear of the resilient annular members fitted over the hulling rolls, and consequently the operator has had to be very alert and keep an eye on any reduction in the thickness of the resilient annular members lest the metallic annular members should be exposed due to wear of the resilient annular members, because this phenomenon causes the hulled grain to be crushed by the metallic annular members or causes the surfaces of the hulling rolls disposed in spaced juxtaposed relation to be subjected to excessive friction which would heat the rolls and damage the annular members. Thus, the hulling machine of the prior art has had the disadvantage that operation of such machine puts a strain on the nerves of the operator because he must keep a watchful eye on wear of the resilient annular members of the rolls at all times. U.S. Pat. No. 4,066,012 describes and claims a roll-type huller.

The present invention has been developed for the purpose of obviating the aforementioned disadvantage of the prior art. Accordingly, the invention has as its object the provision of an automatic safety device for a hulling machine which enables the operator to perform a hulling operation without worrying about wear of the resilient annular members fitted over the hulling rolls because the device automatically detects wear of the resilient annular members of the hulling rolls reaching a predetermined degree and warns the operator or automatically interrupts the operation of the hulling rolls.

According to the present invention, there is provided an automatic safety device for a hulling machine comprising a housing, a pair of hulling rolls arranged parallel to each other in the housing and each having a metallic annular member and a resilient annular member fitted thereover in the indicated order, a fixed rotary main shaft supporting one of the pair of hulling rolls and mounted in the housing for rotation about a fixed center axis, a movable rotary ancillary shaft supporting the other hulling roll and rotatably supported by an arm pivotally supported by a support shaft mounted in the housing in spaced apart parallel relation to the fixed center axis of the fixed rotary main shaft so that the movable rotary ancillary shaft can be moved toward and away from the fixed rotary main shaft while being maintained in parallel thereto, means for driving the fixed rotary main shaft and the movable rotary ancillary shaft, and means for forcing the movable rotary ancillary shaft to move toward the fixed rotary main shaft, such automatic safety device comprising detecting means for detecting wear of at least one of the resilient annular members fitted over the hulling rolls progressing to such a degree that a predetermined wear limit radius has been reached, and a safety control electric circuit connected to the detecting means.

According to the present invention, there is also provided an automatic safety device of the type described, wherein the detecting means comprises photoelectric means arranged in spaced juxtaposed relation to a predetermined wear limit radius position of the resilient annular member on one end surface of at least one of the hulling rolls.

According to the present invention, there is also provided an automatic safety device of the type described, wherein the photoelectric means is mounted on a cover detachable attached to the housing.

According to the present invention, there is also provided an automatic safety device of the type described, wherein the detecting means comprises a screw connected to the arm and projecting in the direction of movement of the arm, and a switch supported by the housing and located in the path of movement of the screw.

According to the present invention, there is also provided an automatic safety device of the type described, wherein the detecting means comprises a light blocking member supported by one of the arm and the housing, and photoelectric means supported by the other of the arm and the housing in a position in which the photoelectric means is actuated by the light blocking member when wear of the resilient annular member of at least one of the hulling rolls has progressed to such a degree that a predetermined wear limit radius has been reached.

Figure 1:
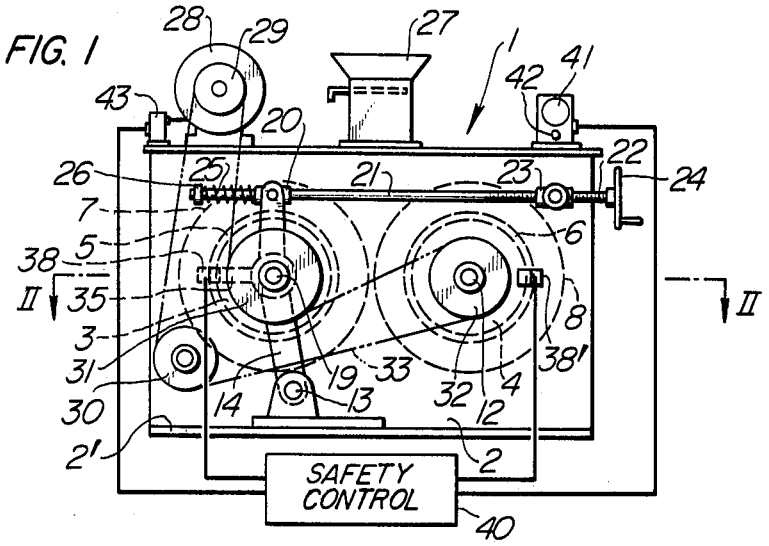
FIG. 1 is a rear view of the hulling machine incorporating therein the automatic safety device comprising one embodiment of the present invention.
Figure 2:
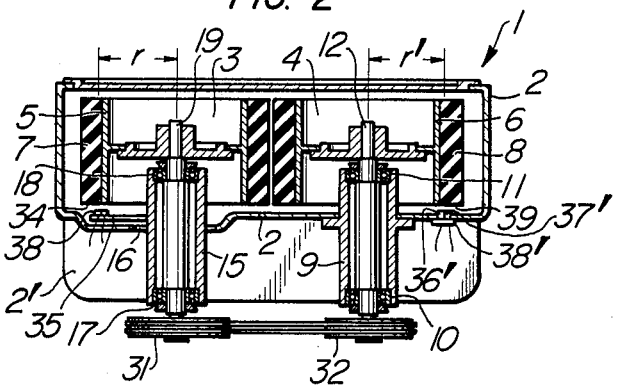
FIG. 2 is a sectional view taken along the line II—II in FIG. 1.

In FIGS. 1 and 2, a hulling machine generally designated by the numeral 1 includes a housing 2, and a pair of hulling rolls 3 and 4 arranged parallel to each other in the housing 2. The hulling rolls 3 and 4 have fitted thereover metallic annular members 5 and 6, and resilient annular members 7 and 8 fitted over the metallic annular members 5 and 6 respectively.

The hulling roll 4 is supported on an inner end of a main shaft 12 for rotation therewith, the main shaft 12 being supported for rotation about a fixed center axis by bearings 10 and 11 mounted in a shaft support tube 9 secured to the housing 2. Rotatably supported by a lower extension 2' of the housing 2 is a support shaft 13 which is parallel to the main shaft 12 and has secured thereto a lower end of an arm 14. Connected to an intermediate portion of the arm 14 is a shaft support tube 15 which is parallel to the shaft support tube 9 of the main shaft 12 and extends through an opening 16 formed in the housing 2 into the housing 2. The shaft support tube 15 has mounted therein bearings 17 and 18 for rotatably supporting an ancillary shaft 19 supporting at its inner end the hulling roll 3 for rotation therewith. The arm 14 is formed at its upper end with a bifurcated portion which pivotally supports a metal member 20 formed with an opening though which extends a threaded shaft 21 disposed parallel to the housing 2 and substantially in a horizontal plane. The threaded shaft 21 is formed at one end portion thereof with a threaded portion 22 in throttle engagement with a nut 23 pivotally supported by the housing 2, and has a handle 24 secured to the outer end of the shaft 21. A spring 25 surrounding the other end portion of the threaded shaft 21 abuts at one end thereof against a nut 26 threadably connected to the other end of the threaded shaft 21 and at the other end thereof against the metal member 20. By turning the handle 24, it is possible to adjust the position of the hulling roll 3 relative to that of the hulling roll 4 by moving the former which is supported by the ancillary shaft 19 pivoted at the support shaft 15 for movement toward and away from the hulling roll 4 which is supported by the main shaft 12 having a fixed center axis.

In FIG. 1, the numeral 27 designates a hopper for supplying grain to the hulling rolls 3 and 4. The numeral 28 designates an electric motor having a pulley 29 mounted on its shaft. The numeral 30 designates a tension pulley. The ancillary shaft 19 has secured thereto a pulley 31 while the main shaft 12 has secured thereto a pulley 32. A belt 33 is trained over these pulleys 29, 30, 31 and 32. The aforesaid construction of the hulling machine is known and described herein to enable the present invention to be better understood.

The automatic safety device according to the present invention used with the hulling machine constructed as described hereinabove will now be described.

Figure 3:
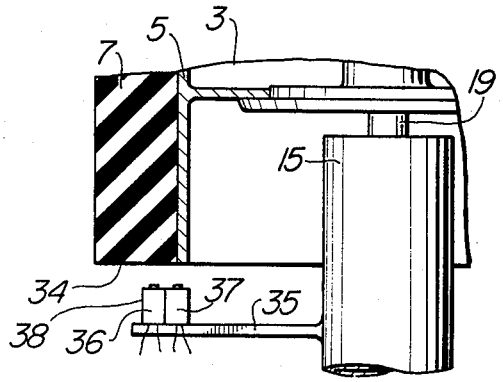
FIG. 3 is a plan view showing, on an enlarged scale, the essential portions of the embodiment shown in FIG. 1, with certain parts being cut away.

FIGS. 1 to 3 show a first embodiment of the invention comprising an arm 35 secured to the shaft support tube 15 supporting the movable rotary ancillary shaft 19 and extending parallel to one end surface 34 of the hulling roll 3 in spaced juxtaposed relation thereto. The arm 35 supports thereon, in a position in spaced juxtaposed relation to a predetermined wear limit radius r of the resilient annular member 7 of the hulling roll 3, photoelectric means 38 comprising a light source 36 and a light receiving element 37. Another light source 36' and another light receiving element 37' are located in a position on the housing 2 which is in spaced juxtaposed relation to a predetermined wear limit radius r' of the resilient annular member 8 on one end surface 39 of the hulling roll 4. The light sources 36 and 36' are constructed such that they throw light onto the positions of the predetermined wear limit radii r and r' on the end surfaces 34 and 39 of the hulling rolls 3 and 4 respectively, so that the light reflected thereby can be detected by the light receiving elements 37 and 37'.

In place of the aforesaid construction, the construction of the photoelectric means may be such that the light sources 36 and 36' and the light receiving elements 37 and 37' are located parallel to the axes of the hulling rolls 3 and 4 in spaced apart positions juxtaposed against the predetermined wear limit radius positions on the end surfaces of the hulling rolls 3 and 4 respectively, so that the light directed from the light sources 36 and 36' will be directly detected by the light receiving elements 37 and 37' respectively. The light receiving elements 37 and 37' are connected to a safety control electric circuit 40 which in turn is connected to one of an alarm 41, an emergency lamp 42 and an electromagnetic switch 43 for the electric motor 28 functioning as drive means for the hulling rolls 3 and 4.

In operation, the handle 24 is turned to adjust the spacing between the outer peripheries of the hulling rolls 3 and 4 in accordance with the type and size of the grain to be hulled. Then the hulling machine is started and grain is supplied through the hopper 27 to between the outer peripheries of the hulling rolls 3 and 4 to perform a hulling operation. As the resilient annular member 7 of the hulling roll 3 is gradually worn and the predetermined wear limit radius r is reached, the light emanating from the light source 36 is not reflected by the light receiving element 37. The same event occurs in respect of the resilient annular member 8 of the hulling roll 4, the light source 36' and the light receiving element 37'. If one of the resilient annular members 7 and 8 reaches the predetermined wear limit radius, the light emanating from the light source is not reflected by the respective light receiving element. When the light source and the light receiving element are located parallel to the axis of the hulling roll in spaced apart positions juxtaposed against the predetermined wear limit radius positions on the end surfaces of the hulling roll, the light emanating from the light source is directly detected by the light receiving element as soon as the predetermined wear limit radius is reached. In either case, a sudden change in the amount of light detected by the light receiving element produces a signal which is supplied to the safety control electric circuit 40 to thereby set off the alarm 41 or turn on the emergency lamp 42 to automatically draw the operator's attention to the fact that the predetermined wear limit radius has been reached, or to switch the contacts of the electromagnetic switch 43 to automatically bring the rotation of the hulling rolls 3 and 4 to a hault. The alarm 41, emergency lamp 42 and electromagnetic switch 43 may be used either singly or in a suitable combination. The light source may be in the form of an incandescent lamp, fluorescent lamp, neon light or light emitting diode.

Figure 4:
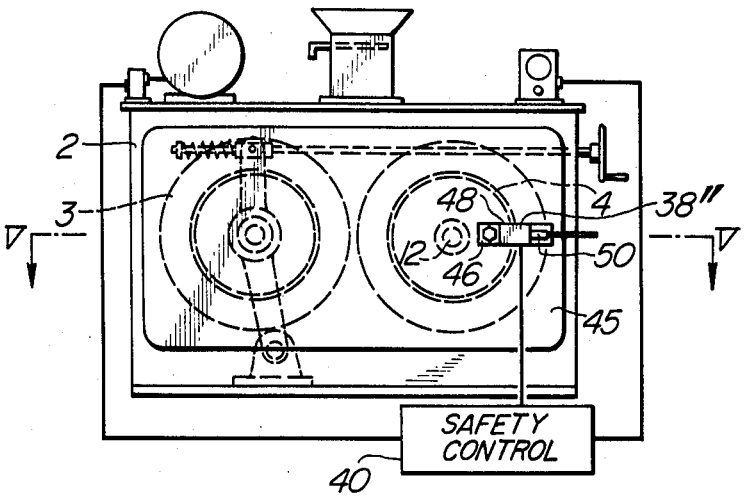
FIG. 4 is a front view of the hulling machine incorporating therein the automatic safety device comprising a second embodiment of the invention.
Figure 5:
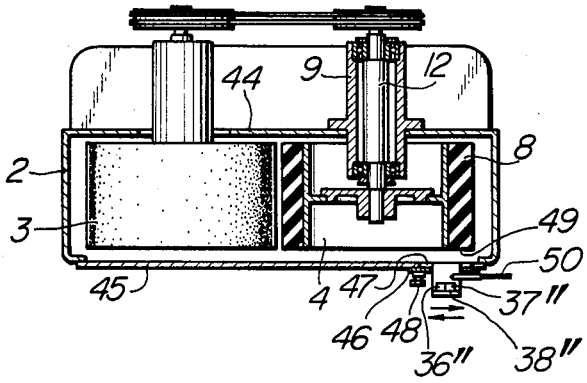
FIG. 5 is a sectional view taken along the line V—V in FIG. 4.

FIGS. 4 and 5 show a second embodiment of the invention wherein a wall opposite to a wall 44 of the housing 2 supporting the shaft support tube 9 rotatably supporting the main shaft 12 is formed as a cover 45 detachably attached to the housing 2. Photoelectric means 38'' comprising a light source 36'' and a light receiving element 37'' is supported on a plate 36 mounted on the cover 45 through adjusting means 48 in such a manner that when the adjusting means 48 is loosened the plate 46 can move in sliding movement in a groove formed on the cover 45 to adjust the position of the plate 46 as indicated by an arrow and when the adjusting means 48 is tightened the plate 46 is fixed in a predetermined position. By this arrangement, the position of the light source 36'' can be readily adjusted in a manner to allow the light emanating from the light source 36'' to be incident on the position of the predetermined wear limit radius r' of the resilient annular member 8 on the end surface 49 of the hulling roll 4.

To avoid deposition of dust on the light source 36'' and light receiving element 37'', an air nozzle 50 is mounted on the plate 46 for flowing a vigorous air stream against them.

The operation of the second embodiment is similar to that of the first embodiment and the detailed description thereof will be omitted.

Figure 6:
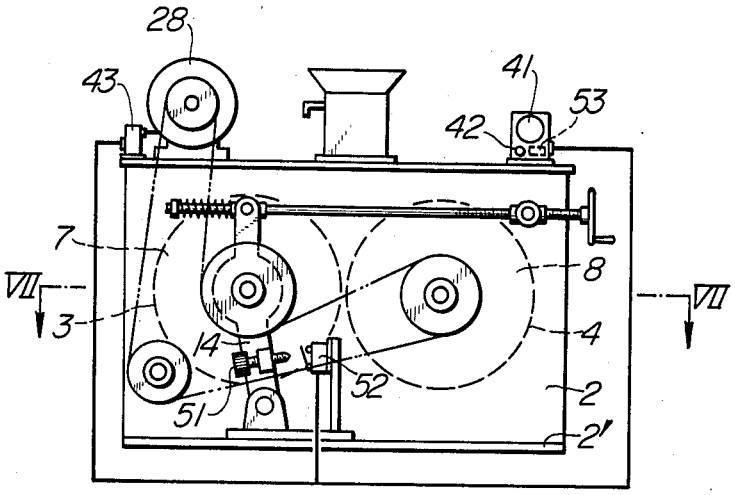
FIG. 6 is a rear view of the hulling machine incorporating therein the automatic safety device comprising a third embodiment of the invention.
Figure 7:
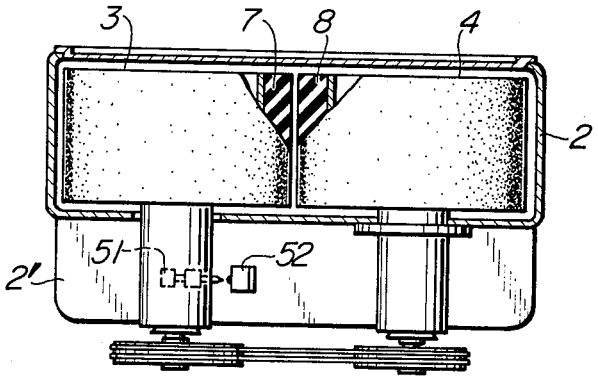
FIG. 7 is a sectional view taken along the line VII—VII in FIG. 6.

FIGS. 6 and 7 show third embodiment of the invention comprising an adjustable screw 51 projecting in the direction of movement of the arm 14 supporting the movable hulling roll 3, from a position disposed midway between the two ends of the arm 14. The adjustable screw 51 can have its position adjusted relative to the arm 14 to thereby adjust the spacing between its forward end and a microswitch 52 located in the path of movement of the adjustable screw 51. The microswitch 52 is mounted on the lower extension 2' of the housing 2 and electrically connected to one of the alarm 41, emergency lamp 42 and electromagnetic switch 43 for the electric motor 28. In FIG. 6, the numeral 53 designates a battery functioning as a power source for the alarm 41 and emergency lamp 42. A contactless switch may be used in place of the microswitch 52.

If the spacing between the forward end of the adjustable screw 51 and the microswitch 52 is adjusted by moving the adjustable screw 51 in such a manner that when one of the resilient annular members 7 and 8 of the hulling rolls 3 and 4 respectively reaches the predetermined wear limit radius the adjustable screw 51 automatically actuates the microswitch 52, then it is possible to automatically actuates the microswitch 52 during operation of the hulling machine as one of the resilient annular members 7 and 8 reaches the predetermined wear limit radius. Actuation of the microswitoch 52 either sets off the alarm 41 or turn on the emergency lamp 42 to inform the operator that one of the resilient annular members 7 and 8 has reached the predetermined wear limit radius. Alternatively, the electromagnetic switch 43 for the electric motor 28 has it contacts switched from one position to another to thereby stop the rotation of the hulling rolls 3 and 4.

Figure 8:
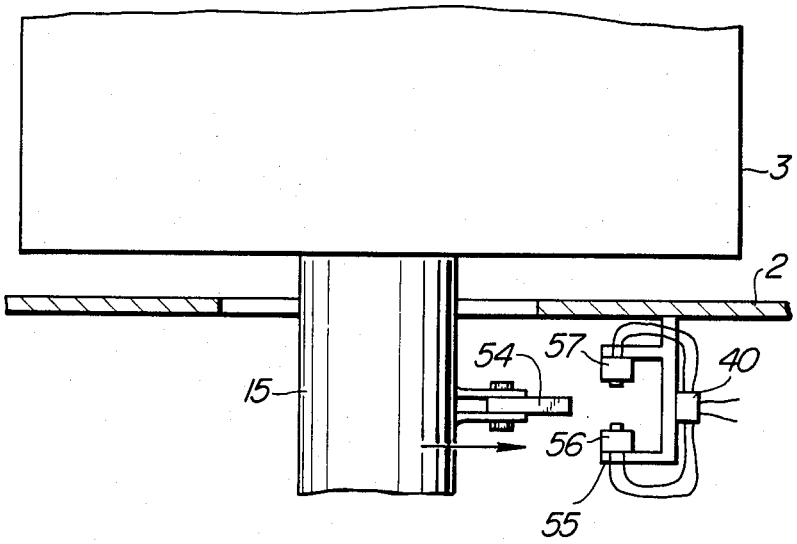
FIG. 8 is a sectional view, on an enlarged scale, of the essential portions of the automatic safety device comprising a fourth embodiment of the invention.

FIG. 8 shows a fourth embodiment comprising a light blocking member 54 secured to the shaft support tube 15 for supporting the movable hulling roll 3 for rotation and projecting in the direction of movement of the shaft support tube 15, and photoelectric means 55 secured to the housing 2 and including a light source 56 and a light receiving element 57 located in spaced juxtaposed relation on opposite sides of the path of movement of the light blocking member 54. The photoelectric means 55 is connected to the safety control electric circuit 40 in a manner to control the latter, the control electric circuit 40 being connected to an alarm, an emergency lamp or an electromagnetic switch, not shown for the electric motor for driving the hulling rolls 3 and 4 in the same manner as described with reference to the preceding embodiments.

Figure 9:
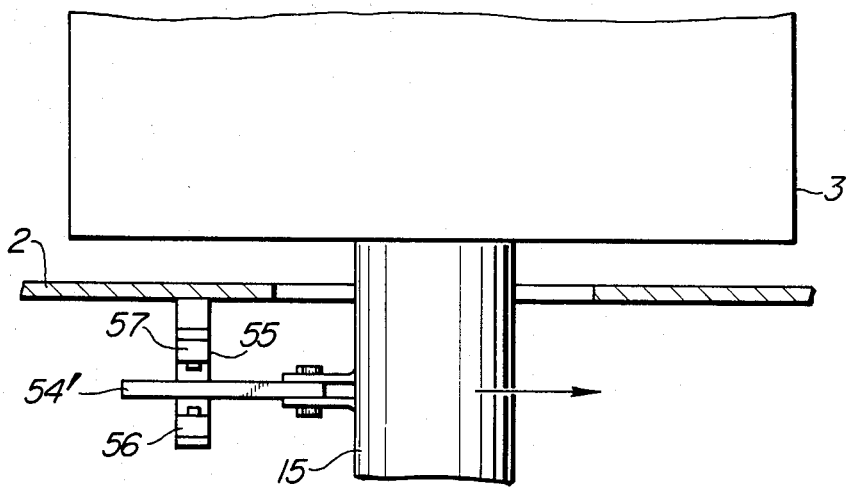
FIG. 9 is a sectional view, on an enlarged scale, of the essential portions of a modification of the automatic safety device shown in FIG. 8.

FIG. 9 shows a modification of the embodiment shown in FIG. 8, wherein the light blocking member 54' is secured to the shaft support tube 15 and projects in a direction opposite to the direction of movement, indicated by an arrow, of the shaft support tube 15 when the hulling roll 3 is worn, and the photoelectric means 55 is secured to the housing 2 in a position in which the light emanating from its light source 56 is blocked by the light blocking member 54' when the hulling machine is in a normal operation condition. As shown, the light blocking member 54' is secured to the shaft support tube 15 and the photoelectric means 55 is secured to the housing 2. However, the light blocking member 54 or 54' may be secured to the arm 14 and the photoelectric means 55 may be secured to the lower extension 2' of the housing 2. Conversely, the photoelectric means 55 may be secured to the arm 14 or the shaft support tube 15 and the light blocking member 54 or 54' may be mounted on the housing side.

In FIGS. 8 and 9, if the spacing between the forward end of the light blocking members 54 and 54' and the photoelectric means 55 is set such that the light is blocked (FIG. 8) or the light is allowed to be incident on the photoelectric means (FIG. 9) when one or both of the hulling rolls 3 and 4 reach the predetermined wear limit radius, then the safety control electric circuit 40 is controlled when the hulling roll or rolls reach the predetermined wear limit radius to set off the alarm or turn on the emergency lamp to inform the operator of the wear of the rolls or to switich the contacts of the electromagnetic switch to bring the hulling rolls to a stop.

What is claimed is:

1. The combination comprising:

a hulling machine comprising a housing, a pair of hulling rolls arranged parallel to each other in said housing and each having a metallic annular member and a resilient annular member fitted over said metallic member, a fixed rotary main shaft supporting one of said pair of hulling rolls and mounted in said housing for rotation about a fixed center axis, a movable rotary ancillary shaft supporting the other hulling roll and rotatably supported by an arm pivotally supported by a support shaft mounted in the housing in spaced apart parallel relation to a fixed center axis of said fixed rotary main shaft so that the movable rotary ancillary shaft can be moved toward and away from the fixed rotary main shaft while being maintained in parallel thereto, means for driving said fixed rotary main shaft and said movable rotary ancillary shaft, and means for forcing the movable rotary ancillary shaft to move toward the fixed rotary main shaft; and an automatic safety device comprising detecting means for detecting wear of at least one of the resilient annular members fitted over said metallic members of said hulling rolls progressing to such a degree that a predetermined wear limit radius has been reached, and a safety control electric circuit connected to said detecting means.

2. The combination as claimed in claim 1, wherein said detecting means comprises photoelectric means arranged in spaced juxtaposed relation to a predetermined wear limit radius position of the resilient annular member on one end surface of at least one of said hulling rolls.

3. The combination as claimed in claim 2, wherein said photoelectric means is mounted on a cover detachably attached to said housing.

4. The combination as claimed in claim 1, wherein said detecting means comprises a screw connected to said arm and projecting in the direction of movement of the arm, and a switch supported by said housing and located in the path of movement of said screw.

5. The combination as claimed in claim 1, wherein said detecting means comprises a light blocking member supported by one of said arm and said housing, and photoelectric means supported by the other of said arm and said housing in a position in which said photoelectric means is actuated by said light blocking member when wear of the resilient annular member of at least one of said hulling rolls has progressed to such a degree that the redetermine wear limit radius has been reached.

6. The combination as claimed in claim 2, wherein said photoelectric means comprises a light source throwing light onto a predetermined wear limit radius position of the resilient annular member of at least one of said hulling rolls, and a light receiving element receiving the light reflected by said predetermined wear limit radius position.

7. The combination as claimed in claim 2, wherein said photoelectric means comprises a light source and a light receiving element located parallel to the axis of one of said hulling rolls in spaced apart positions juxtaposed against predetermined wear limit radius positions of the resilient annular member on opposite end surfaces of said hulling roll.

8. The combination as claimed in claim 6 or 7, wherein said safety control electric circuit includes warning means.

9. The combination as claimed in claim 6 or 7, wherein said safety control electric circuit includes an electromagnetic switch connected to an electric motor constituting said means for driving the hulling rolls.

10. The combination as claimed in claim 3, further comprising adjusting means for adjusting the position in which said photoelectric means is mounted on said cover.

11. The combination as claimed in 3 or 10, further comprising an air nozzle for blowing a vigorous stream of air against said photoelectric means.

12. The combination as claimed in claim 3 or 10, wherein said photoelectric means comprises a light source throwing light onto said predetermined wear limit radius position on one end surface of the resilient annular member, and a light receiving element receiving the light reflected by said predetermined wear limit radius position, and wherein said safety control electric circuit connected to said light receiving element includes warning means.

13. The combination as claimed in claim 3 or 10, wherein said photoelectric means comprises a light source throwing light onto said predetermined wear limit radius position on one end surface of the resilient annular member, and a light receiving element receiving the light reflected by said predetermined wear limit radius position, and wherein said safety control electric circuit connected to said light receiving element includes an electromagnetic switch connected to an electric motor constituting said means for driving the hulling rolls.

14. The combination as claimed in claim 4, wherein said switch is connected to warning means.

15. The combination as claimed in claim 4, wherein said switch is connected to an electromagnetic switch connected to an electric motor constituting said means for driving the hulling rolls.

16. The combination as claimed in claim 5, wherein said photoelectric means comprises a light source and a light receiving element arranged in spaced juxtaposed relation on opposite sides of the path of movement of said light blocking member relative to said photoelectric means, and wherein said safety control electric circuit connected to said light receiving element includes warning means.

17. The combination as claimed in claim 5, wherein said photoelectric means comprises a light source and a light receiving element arranged in spaced juxtaposed relation on opposite sides of the path of movement of said light blocking member relative to said photoelectric means, and wherein said safety control electric circuit connected to said light receiving element includes an electromagnetic switch for an electric motor constituting said means for driving hulling rolls.

* * * * *

UNITED STATES PATENT AND TRADEMARK OFFICE

CERTIFICATE OF CORRECTION

PATENT NO. : 4,279,261

DATED : July 21, 1981

INVENTOR(S) : Toshihiko Satake

It is certified that error appears in the above—identified patent and that said Letters Patent is hereby corrected as shown below:

On the cover sheet insert Foreign Application Priority Data

-- (30) November 14, 1978 Japan 53-140884

November 14, 1978 Japan 53-140885 --.

Signed and Sealed this

Fifth Day of January 1982

[SEAL]

Attest:

GERALD J. MOSSINGHOFF

Attesting Officer

Commissioner of Patents and Trademarks